United States Patent [19]

Bolis

[11] 3,954,212

[45] May 4, 1976

[54] METHOD FOR MAKING RIBBONS CURLABLE IN A COCKADE FASHION

[76] Inventor: Ernesto Bolis, Via Ravasio, 1, Ponte S. Pietro (Bergamo), Italy, 24036

[22] Filed: Jan. 23, 1975

[21] Appl. No.: 543,510

[30] Foreign Application Priority Data

July 23, 1974 Italy ..... 2911/74

[52] U.S. Cl. ..... 223/46

[51] Int. Cl.[2] ..... A41H 43/00

[58] Field of Search ..... 223/46; 428/4; 57/24, 57/156, 167, 143; 28/2; 289/1.2, 1.5; 112/410, 411; 156/226, 227

[56] References Cited

UNITED STATES PATENTS

| | | | |
|---|---|---|---|
| 3,236,426 | 2/1966 | Kerrigan et al. | 223/46 |
| 3,283,339 | 11/1966 | Heifetz | 428/4 X |
| 3,587,946 | 6/1971 | Christensen | 223/46 |
| 3,632,464 | 1/1972 | Grikis | 428/4 |
| 3,637,455 | 1/1972 | Pearson et al. | 161/49 |
| 3,790,041 | 2/1974 | Pearson et al. | 223/46 |

*Primary Examiner*—G. V. Larkin

[57] ABSTRACT

A method for making ribbons curlable in a cockade, comprising the steps of longitudinally superimposing to a base ribbon a tape, causing the ribbon to pass along with the tape in a shearing unit for laterally shearing on the two sides of the ribbon two roundish cuts or notches and inserting on the ribbon and tape superimposed thereto a metal ring at the center of the sheared area at each of the ribbon shearing locations, the operations being in timing relationship with the feeding system for the ribbon and tape.

2 Claims, 5 Drawing Figures

METHOD FOR MAKING RIBBONS CURLABLE IN A COCKADE FASHION

This invention relates to a method for making ribbons curlable in a cockade fashion, wherein a ribbon of any material comprises a base ribbon having thereon a traction tape connected at predetermined locations to said ribbon by means of metal rings.

As well known, there is an increasing tendency in applying for decorative purposes, particularly on gift or present packages or bundles, a ribbon knot or cockade which can be provided by drawing a tape on a suitably made ribbon. Cloth ribbons have been known, wherein a tape is interwoven at intervals in a longitudinal direction according to certain predetermined locations, so that by suitably drawing or pulling the tape and holding the ribbon length, a knot is obtained resembling that of a rosette or a cockade.

In addition to the high cost of the material, such fabric ribbons suffer from the disadvantage of complexity in manufacturing operations, and also in that the ribbon fabric does not properly curl up, thus providing a final terry or cockade, the aesthetical appearance of which is not always satisfactory.

In order to overcome such disadvantages, it has been proposed to use ribbons of plastic material, thereby significantly reducing the costs of material and manufacture. Particularly, for providing and manufacturing ribbons of plastic material that can be curled up in a cockade fashion, two superimposed plastic ribbons, heat sealed to each other at predetermined intervals, are provided. Internally of such ribbons provision is made for one or more pull tapes, serving the purpose of forming the desired curls or knots. Also in this case, it should be noted that the knots provided are not always of aesthetical pleasant appearance because of either having an unduly geometrical sharp edge aspect, or having curls which are nonuniform to one another. Particularly, this is due to the fact that the heat sealing points or spots are located lengthwise of the superimposed plastic ribbons, comprising the base for each of the individual knots or lobes formed. To achieve such a sealing, the ribbon should necessarily be of a substantial thickness and heat sealable, so that no uneveness would result from the substantial thickness or stiffness of the ribbon and different bending capability at these heat sealing points or spots, particularly when the latter are diagonally arranged to the longitudinal axis of the ribbon.

It should also be noted that such superimposed heat-sealed ribbons can be used only at predetermined lengths or sections since, should a length be cut from a roll at any location, the pull tapes provided on the ribbons and heat sealed to the end of a given superimposed length would slip out, thus preventing any curl or knot from being formed, which inter alia are restricted to only large knots, because of the sealing requiring ribbons of a substantial width.

Finally, it should be added that such known methods can be exclusively used for ribbons of plastic material, so that such ribbons could not be used as those made of artificial fabric, paper or other commercially available materials for decorative use, with the exception of those purposely woven according to the above mentioned method for the pull tape type of ribbon.

It is the object of the present invention to provide a method for making ribbons curlable in a cockade fashion and the like, which is free of all of the above mentioned disadvantages.

According to the invention, this is accomplished by a method for the above objects, the method being characterized by comprising the steps of unwinding from a roll and supplying in a given feeding direction at least one ribbon, causing it to forwardly move by predetermined steps, and at the same time unwinding from another roll a tape which, also fed in predetermined steps and inserted between the same guide elements as those for the ribbon and on which guide elements said ribbon passes, so as to be centrally superimposed thereto, causing said ribbon to pass along with the tape in a shearing unit, the punches of which provide at the desired location for laterally shearing on the two sides of the ribbon a portion of the latter to leave on the ribbon at said shearing area two roundish cuts or notches, and then upon continued forward movement of said ribbon with the tape superimposed thereto causing the ribbon to pass adjacent a stitching or sewing machine which, upon being tripwise controlled by the same stepped feeding system, will insert on the ribbon and superimposed tape a metal ring at the center of the sheared area at each of the ribbon shearing locations, so that the ring which is closed will hold the ribbon and tape together, and finally supplying said prepared ribbon to a final take up roll.

The article, as provided by the aforementioned method, is characterized by comprising at least one base ribbon of any material, on which a tape is centrally superimposed in a longitudinal direction, at predetermined and suitably varying intervals or spacings said ribbon is sheared on the two sides so as to have on each of the sides at the shearing area a deep roundish cut or notch, leaving at the center of the ribbon a comparatively thin connection strip, so that a bending promoting area or zone is provided. On each of the connecting strips at the shearings and particularly at the bending area, a small metal ring is folded and tightened about the base ribbon and tape permitting the latter to slide in the small metal rings when forming the desired knot.

In addition to its extreme simplicity, an advantage of the method according to the invention resides in that it can be used for any type of decorative ribbon.

Another advantage of a ribbon as provided by the method according to the present invention resides in that, since no heat sealing points or spots are provided at the end of the pull tapes, to form the desired knot, ribbon lengths of any desired length can be cut from the roll.

A further advantage of the method according to the invention resides in that on the take up roll the ribbon is already internally wound with the tape, thus taking on some arcuate pattern facilitating the later formation of the individual lobes of each knot.

These and further objects, characteristics, peculiarities and advantages of the method and ribbon according to the present invention will become more apparent from the following brief detailed description of an embodiment, given by way of non-limiting example, as taken in conjunction with the accompanying drawings in which.

Figure 1:
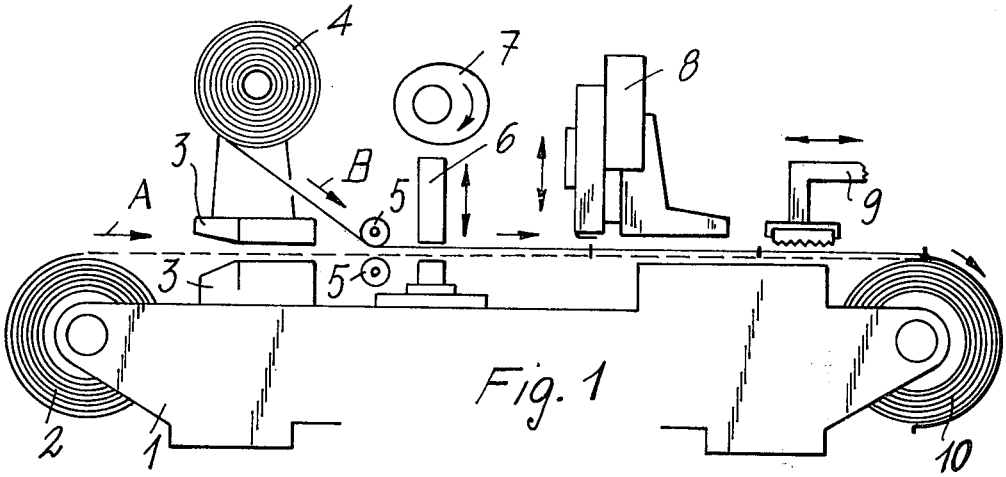
FIG. 1 is a diagrammatic view showing the processing line for the manufacture of a ribbon according to the invention.
Figure 2:
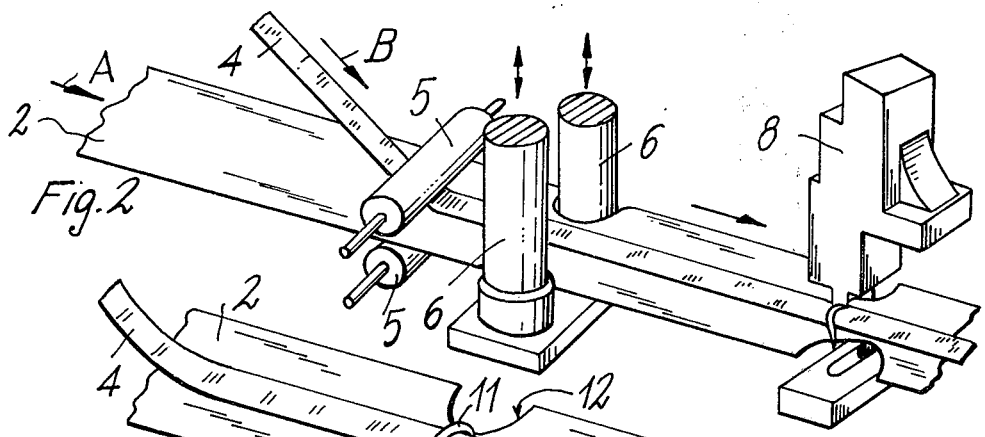
FIG. 2 is a detailed view of the operational portion of FIG. 1.

Referring to the drawings and particularly to FIGS. 1 and 2, reference numeral 1 designates a working table, at the left end of which, as seen on the drawing, provision is made for at least one roll of ribbon which is supplied to the processing line in the direction shown by arrow A, passing through the guide elements 3. At a suitable location, provision is also made for a further roll 4 having thereon the tape to be arranged on the ribbon supplied from said roll 2, the tape 4 being supplied in the direction shown by arrow B, then passing between guide rollers 5 with ribbon 2 also passing therethrough, so that said tape 4 is longitudinally superimposed on said ribbon 2 at the central zone of the latter.

A further processing station provides a shearing unit comprising punches and punch blocks 6, as controlled by a suitable means 7. Upon stepwise forward movement of ribbon 2 along with said superimposed tape 4, these punches 6, as suitably controlled in timing relationship with the forward movement of the ribbon, are lowered for each of the feeding steps, shearing a length or section on either side of the ribbon, thus leaving a cut or notch 12 of a roundish shape, as better shown in FIG. 3.

The next processing station comprises a stitching or sewing machine performing the function of stitching and inserting a small metal ring 11 on the ribbon and overlying tape at the sheared areas 12, just at the center of such sheared areas where the connecting strip being left between the various non-sheared ribbon lengths or sections is per se a bending promoting zone. The unit, as designated by reference numeral 9, merely comprises a pulling unit performing the function of supplying the processed ribbon to the take up roll or spool 10. Obviously, it is contemplated that both the shearing unit 6 and the inserting unit 8 for the small metal rings can be moved so as to vary the ribbon shearing pitch, that is to provide for said shearings 12 at a spacing more or less close to one another in a longitudinal direction.

Figure 3:
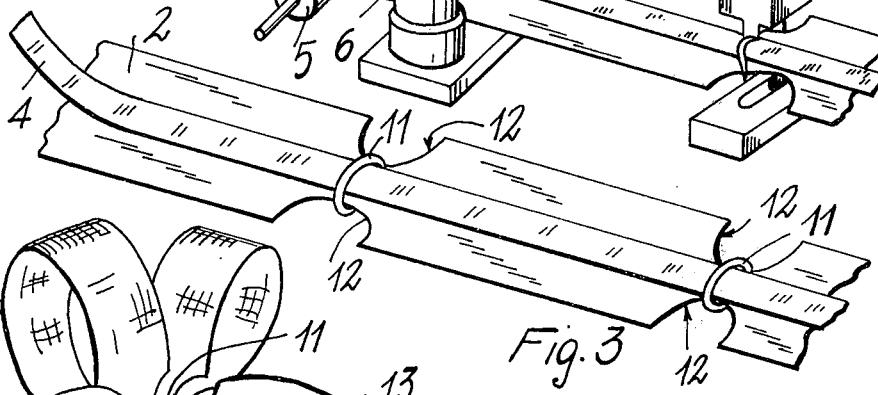
FIG. 3 is a view showing a ribbon length as obtained by the method according to the invention.
Figure 5:
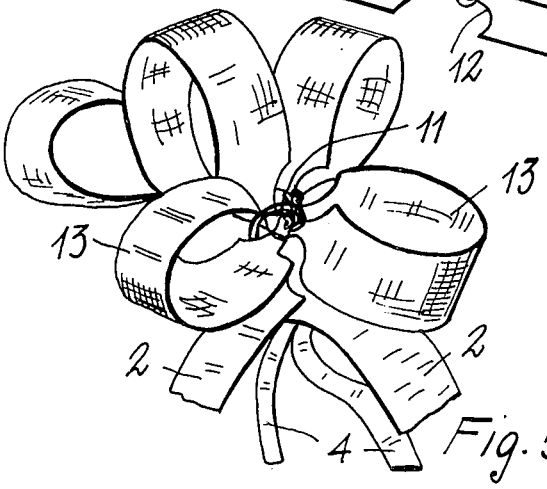
FIG. 5 shows an exemplary knot made with the ribbon according to the invention.
Figure 4:
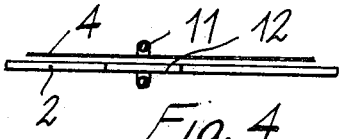
FIG. 4 is a sectional view of the ribbon shown in FIG. 3.

Considering now FIGS. 3 and 5, it will be seen that by cutting from said roll or spool 10 a ribbon section of optional length, manually joining the two ends of the cut ribbon and pulling with the other hand the two ends of tape 4, a knot would be provided which will take on a rosette or cockade-like aspect, such as shown in FIG. 5, the bending of each individual lobe at the small metal rings 11 being facilitated, as above discussed, by the thinning effect due to shearing operations at 12, as well as by the fact that the ribbon on the final take up roll or spool 10 has already taken on some arcuate pattern and hence the tendency to bend in lobes 13.

Obviously, possible changes and equivalent modified embodiments as made on the ground of the present inventive concept would be within the scope of the invention.

What is claimed is:

1. A method for making ribbons which can be curled up in various aesthetically pleasing configurations, the method comprising the steps of:

unwinding from at least one ribbon supply roll at least one ribbon;

feeding said ribbon in a given feed direction in a stepwise fashion by predetermined steps through a set of guide elements;

simultaneously unwinding a tape from a tape supply roll;

feeding said tape in said feed direction in a stepwise fashion by the same predetermined steps as for the ribbon;

passing said tape in superimposed relation to said ribbon between said set of guide elements so that the tape lies longitudinally of the ribbon and at the central area thereof;

feeding said ribbon along with the tape to a shearing area;

laterally shearing a portion of both lateral sides of the ribbon to define two opposed roundish side cuts;

feed said sheared ribbon along with said superimposed tape to a stitching area;

closing a metal ring around said ribbon and tape at the center of each sheared area, in timing relationship with the stepping of said ribbon, so that upon being closed about said ribbon said ring holds the ribbon and tape together in a loose sliding relationship; and transferring said ribbon, tape, and rings so assembled to a final take-up roll.

2. The method as set forth in claim 1, wherein said steps of shearing said ribbon and closing said ring are performed in a manner to vary the spacing between successive sheared areas and rings.

* * * * *